US007487644B2

(12) United States Patent
Carr et al.

(10) Patent No.: US 7,487,644 B2
(45) Date of Patent: Feb. 10, 2009

(54) CRYOSTAT ASSEMBLY

(75) Inventors: Philip Alexander Carr, Oxon (GB); Oleg Kirichek, Oxon (GB); Milind Diwakar Atrey, Oxon (GB)

(73) Assignee: Oxford Instruments Superconductivity Limited, Oxford (GB)

( * ) Notice: Subject to any disclaimer, the term of this patent is extended or adjusted under 35 U.S.C. 154(b) by 362 days.

(21) Appl. No.: 11/282,671

(22) Filed: Nov. 21, 2005

(65) Prior Publication Data

US 2006/0137363 A1 Jun. 29, 2006

(30) Foreign Application Priority Data

Dec. 24, 2004 (GB) ..... 0428406.3

(51) Int. Cl.
*F17C 3/10* (2006.01)
*F17C 5/02* (2006.01)
*F25D 19/00* (2006.01)

(52) U.S. Cl. ..... 62/48.2; 62/47.1; 62/296

(58) Field of Classification Search ..... 62/47.1, 62/48.2, 51.1, 296

See application file for complete search history.

(56) References Cited

U.S. PATENT DOCUMENTS

| | | | | | |
|---|---|---|---|---|---|
| 3,986,550 | A | * | 10/1976 | Mitsuoka | 165/104.21 |
| 4,790,147 | A | * | 12/1988 | Kuriyama et al. | 62/51.1 |
| 4,986,077 | A | * | 1/1991 | Saho et al. | 62/51.1 |
| 5,086,619 | A | * | 2/1992 | Huang et al. | 62/50.1 |
| 5,267,445 | A | | 12/1993 | Schittenhelm et al. | |
| 5,339,650 | A | * | 8/1994 | Hakamada et al. | 62/51.1 |
| 5,864,273 | A | * | 1/1999 | Dean et al. | 335/216 |
| 7,076,960 | B2 | * | 7/2006 | Takemasa | 62/6 |

FOREIGN PATENT DOCUMENTS

EP 0 864 878 A1 9/1998

* cited by examiner

*Primary Examiner*—William C Doerrler

(57) ABSTRACT

A cryostat assembly comprises a liquid coolant containing vessel; a mechanical cooler having at least one cooling stage located above the vessel; and a channel for conveying gaseous coolant from the vessel to the cooling stage where the coolant is condensed in use and then returns through the channel to the vessel. An acoustic wave attenuator is located in the channel for attenuating the passage of acoustic energy originating from the mechanical cooler and propagating through the gaseous coolant, while permitting flow of gaseous coolant to the cooling stage and flow of condensed coolant to the vessel.

16 Claims, 3 Drawing Sheets

CRYOSTAT ASSEMBLY

The invention relates to a cryostat assembly, for example for cooling a superconducting magnet or the like to very low temperatures. Such assemblies are used in applications such as nuclear magnetic resonance (NMR), magnetic resonance imaging (MRI), ion-cyclotron resonance (ICR) and dynamic nuclear polarisation (DNP).

In a typical experiment using such a cryostat assembly, typically cooling a superconducting magnet, it is necessary to detect relatively weak signals emitted by a sample under test. It is important that extraneous noise signals are eliminated to enable the test signal to be clearly detected. One problem, which has occurred in the past, is that the mechanical coolers used as part of the cryostat assembly cause mechanical vibrations which are transmitted to the remainder of the cryostat assembly through the walls of the assembly. In order to avoid this problem, isolating devices such as bellows have been incorporated. Examples of such known systems are described in US-A-2004/0051530, EP-A-00903588, and EP-A-00864878.

Despite these measures, we have found that output spectra still show some noise effects. For example, FIG. 1 illustrates part of a NMR noise spectrum obtained from an Oxford Instruments ActivelyCooled 400 Cryostat fitted with a pulse-tube refrigerator. This is produced from the lock-in proton signal of a sample of water, the resulting peaks representing the noise seen in the NMR measurement. It will be seen that a significant noise effect is present at around 1-2 Hz.

In accordance with the present invention, a cryostat assembly comprises a liquid coolant containing vessel; a mechanical cooler having at least one cooling stage located above the vessel; a channel for conveying gaseous coolant from the vessel to the cooling stage where the coolant is condensed in use and then returns through the channel to the vessel; and an acoustic wave attenuator located in the channel for attenuating the passage of acoustic energy originating from the mechanical cooler and propagating through the gaseous coolant, while permitting flow of gaseous coolant to the cooling stage and flow of condensed coolant to the vessel.

We realised that the noise effect which had been observed was not due to mechanical vibrations transmitted through the cryostat walls but rather acoustic vibrations imposed on the gas volume above the liquid level of the cryostat triggered by the mechanical cooler which vibrates at about 1 Hz frequency.

To overcome this problem, we inserted an acoustic wave attenuator in the channel used for conveying gaseous coolant from the vessel to the cooling stage and for returning liquid coolant to the vessel. However, the precise nature of that attenuator needs to be carefully considered so as not to unduly affect the flow of gaseous and liquid coolant. In practice, this optimisation will need to be determined empirically.

Typically, the acoustic wave attenuator comprises a member having at least one channel with a diameter less than the wavelength of acoustic waves in the gas. Preferably, however, the attenuator comprises many such channels and the diameter of the channels should be many orders of magnitude less than the wavelength of sound in the coolant gas such as helium so as to cause diffusive propagation of sound accompanied by high decay of sound amplitude.

The channels may have a rectilinear form and be located in a regular or irregular array although non-rectilinear channels are also envisaged.

We have realised that as well as resisting the propagation of acoustic vibrations imposed on the gas volume, the acoustic wave attenuator serves another important function. That is, it offers resistance to coolant gas flow during removal of the "cold head" so that the boil-off gas would travel through other vent paths which offer minimum resistance to the boil-off.

Preferably, the acoustic wave attenuator is of low thermal conductance although this is not essential.

Examples of a mechanical cooler comprise a cryo-cooler such as a pulse-tube refrigerator, Gifford-McMahon refrigerator, stirling cooler, and a Joule-Thomson cooler.

As mentioned above, the assembly can be used to cool an item located in, or thermally connected to, the coolant containing vessel such as a superconducting magnet.

An example of a cryostat assembly according to the invention will now be described with reference to the accompanying drawings, in which.

Figure 3:
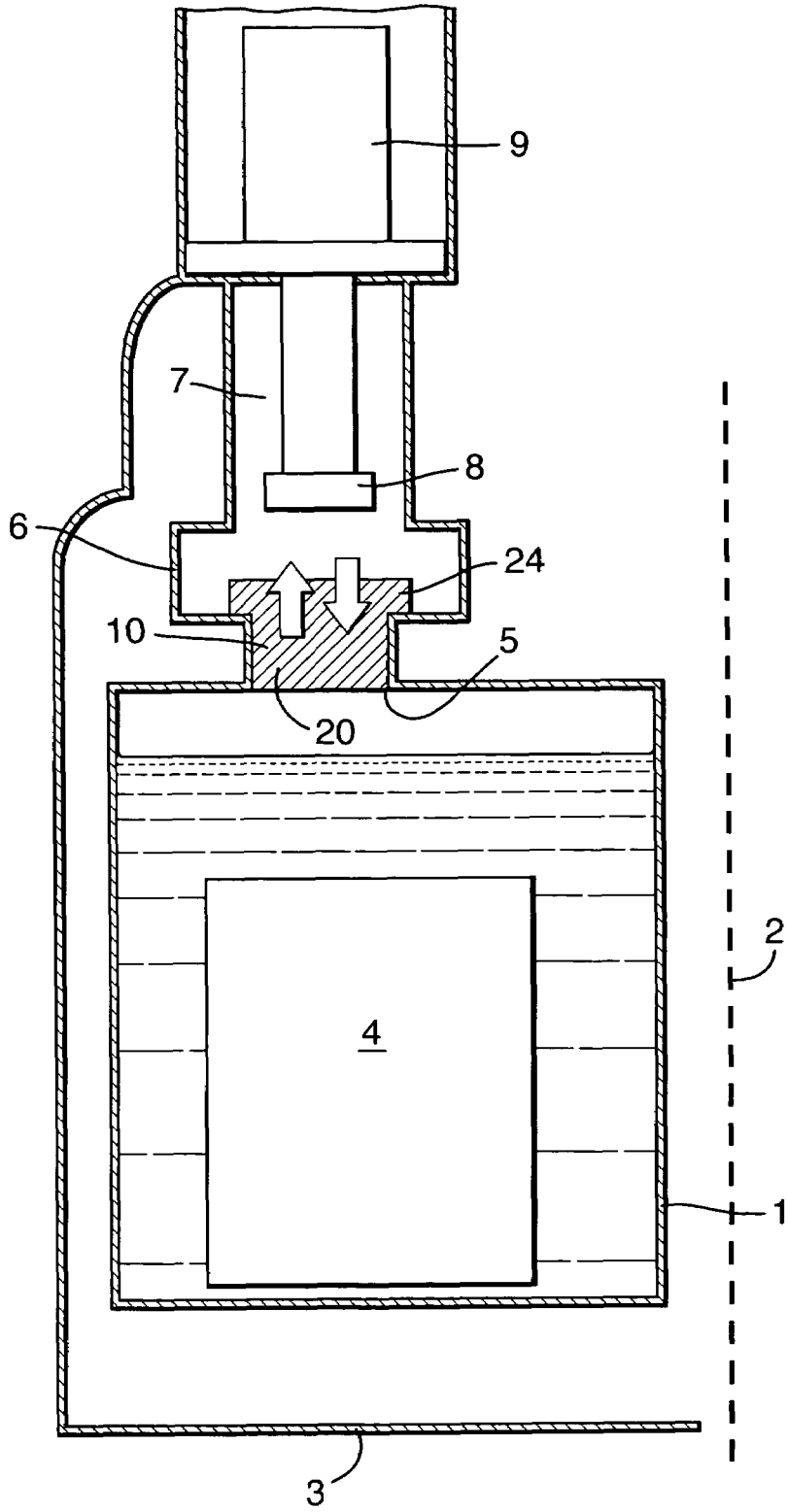
FIG. 3 is a schematic diagram of an example of a cryostat assembly according to the invention.

FIG. 3 illustrates schematically part of a cryostat assembly for use in NMR, the assembly comprising an annular, liquid helium vessel 1 located about an axis 2 defining a bore (not shown). In practice, the vessel 1 will be surrounded by a number of thermal shields and possibly other coolant containing vessels but for simplicity only a single 50K thermal shield 3 is shown.

A superconducting magnet of annular form 4 is provided in the vessel 1 and also surrounds the axis 2.

The upper wall of the vessel 1 is provided with an aperture 5. The aperture 5 communicates with a cavity 6 having an outwardly extending tube or turret 7 in which is located the second stage 8 of a two stage pulse tube refrigerator (PTR) 9. Typically, part of the wall of the cavity 6 will be formed as a bellows to restrict the passage of vibrations.

In use, heat reaching the vessel 1 will cause liquid helium to boil and the gaseous helium passes up through the aperture 5 into the cavity 6 where it condenses on the second stage 8 of the PTR 9, the resulting liquid falling back into the vessel 1.

As explained above, it has been found that mechanical vibration of the PTR 9 not only vibrates the walls of the cryostat assembly but also causes acoustic waves to propagate through the gaseous helium within the cavity 6 back into the vessel 1 and hence cause noise to appear on NMR signals obtained from samples in the bore.

In order to solve this problem, one of the apertures 5 is filled with an acoustic wave attenuator plug 10.

Figure 4A:
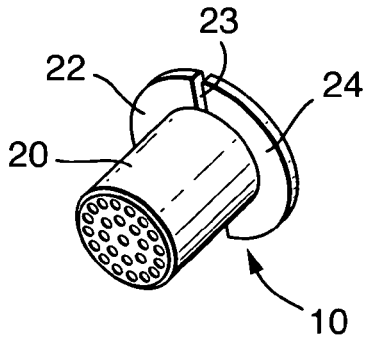
FIGS. 4A-4C are a perspective view, end view from below, and section on the line A-A in FIG. 4B respectively of an example of an acoustic wave attenuator plug according to the invention; and, FIG. 5 illustrates the parameters needed for discussing the theory behind the invention.
Figure 4B:
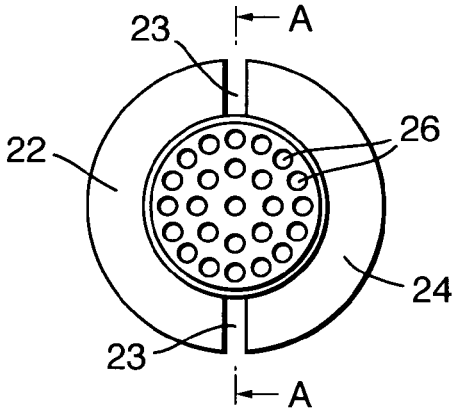

An example of such a plug 10 is shown in more detail in FIG. 4. As can be seen in FIG. 4A, the plug comprises a cylindrical body portion 20 at the upper end of which are provided a pair of laterally outwardly extending, semi-circular flanges 22,24. Gaps 23 are formed between the flanges 22,24 to allow for drainage of liquid helium.

The plug 10 is made of a low thermal conductivity material such as PTFE, stainless steel, G-10, foam, plastics, FRP or ceramic.

In this example, G-10 is used and the plug has a regular array of 25 holes 26, each having a diameter of 2.5 mm and extending in rectilinear form along the length of the body 20.

Figure 4C:
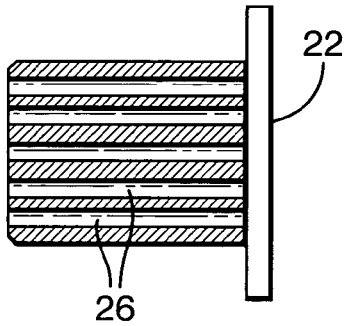

These can be seen most clearly in FIG. 4C and it will be noted that each channel 26 has a length of 32 mm. These dimensions should be compared with the wavelength of sound in helium at low temperatures which is about 104 m.

The plug 10 is inserted into the cavity 5 with the body 20 filling the cavity 5 and the flanges 22,24 extending partly over the base of the cavity 6.

The theoretical background of the invention will now be described.

The plug 10 is fixed in the space 5 through which the condenser on the 2nd stage 8 of the PTR 9 sees the liquid Helium in the Helium vessel 1. It has to satisfy two criteria a) to isolate the acoustic vibrations set up in the helium gas by the PTR 2nd stage from the helium vessel and b) to let the boil off helium gas flow up through it and let the condensed liquid helium fall back to the Helium vessel through it.

Figure 5:
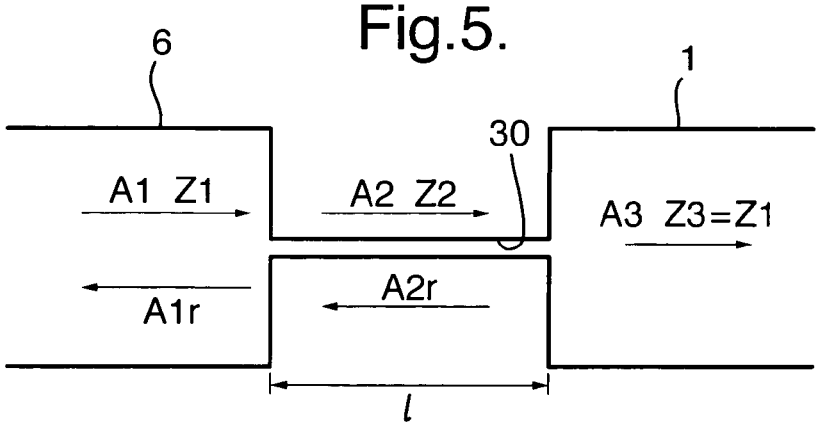

FIG. 5 shows a schematic of how the plug works. The passage 30 connects the two areas 1 and 6. The area 6 can be viewed as a source of vibration, a PTR in the present case, passage 30 is the plug position with small channels, and the area 1 is the Helium can or vessel with liquid Helium in it. A1 is the amplitude of the acoustic vibrations generated by the PTR in the area 6 while A2 and A3 are the amplitude of the acoustic vibrations carried through the plug and the helium can resp. Z1, Z2, Z3 are the acoustic impedance in the respective places while A1r and A2r are the amplitudes of the reflected acoustic vibration. l is the length of the plug 10. For our understanding consider Z3=Z1. There are typically two area changes in this case, which is from 6 to 30 and from 30 to 1. These area changes are responsible for the amplitude reduction or damping of the acoustic vibrations.

A1 is the amplitude of the vibration at the source that is the largest in magnitude. The objective of the plug is to minimise the value of A3 which is the amplitude of the acoustic vibration that ultimately reaches the helium can. To achieve this, the values of A1r and A2r should be maximised by increasing the impedance Z1 and Z2.

From the basic theory of acoustics:

$$(A1r/A1)=(1-Z2/Z1)/(1+Z2/Z1)$$

for l>>d (where l and d are the length and the diameter of the channel of the plug respectively $$A3/A1=2/\mathrm{sqrt}(2+Z1/Z2+Z2/Z1)$$

which approximately gives the following equation.

$$A3/A1\cong 2/\mathrm{sqrt}(\lambda/R)$$

where λ is the wavelength of the vibration in a given medium and R is the radius of the channel=d/2.

So, effectively for a case where l>>d the amplitude transmitted through the channel depends directly on the radius of the channels in the plug and it should be as small as possible in order to keep A3 small.

If the velocity of sound in air is 104 m/sec, that means for 1 Hz frequency λ would be 104 m. If R is around 1 mm then, A3/A1=0.0062 which is a 99.38% reduction of the amplitude.

At the same time, however, the diameter of the channel can not be reduced to a greater extent as it would offer resistance to the gas flow upwards. The pressure drop, Δp, across a channel of length l, diameter d for flow velocity v, density ρ and friction factor F is $$\Delta p=\rho F l v^2/(2d)$$

which shows that if the diameter is reduced or the length is increased, the pressure drop would increase causing restriction to the gas flow across the channel.

This necessitates the need to optimise the diameter and length of the acoustic plug so that it offers resistance to the transmission of acoustic vibrations but at the same time does not restrict the flow of helium gas through it.

Figure 1:
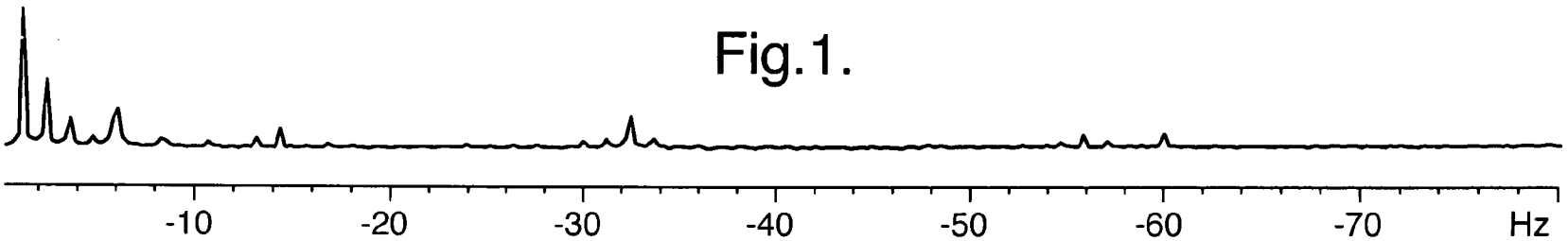
FIG. 1 illustrates the noise component of a NMR spectrum obtained from a prior art assembly.
Figure 2:
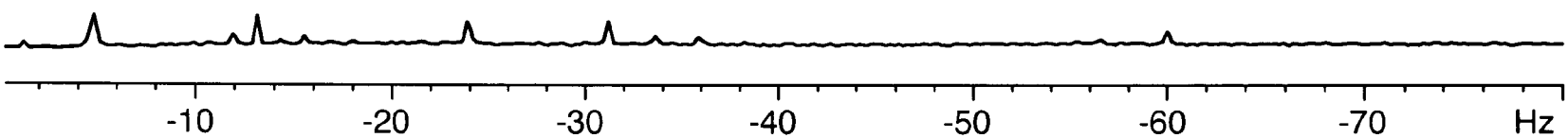
FIG. 2 is a spectrum similar to that of FIG. 1 and obtained from the same assembly but after modification to incorporate an acoustic wave attenuator according to an example of the invention.

The affect of the invention can be seen by comparing FIGS. 1 and 2. The significant noise component at low frequencies in FIG. 1 has been eliminated in the spectrum of FIG. 2.

We claim:

1. A cryostat, comprising:

a liquid coolant containing vessel;

a pulse-tube refrigerator having at least one cooling stage located above the liquid coolant containing vessel;

a channel for conveying gaseous coolant from the liquid coolant containing vessel to the at least one cooling stage where the gaseous coolant is condensed in use and then returns through the channel to the liquid coolant containing vessel; and an acoustic wave attenuator with a cylindrical body in which are formed a plurality of channels arranged in a regular array, located in the channel for attenuating an acoustic wave originating from the pulse-tube refrigerator and propagating through the gaseous coolant, while permitting a flow of gaseous coolant to pass to the cooling stage and a flow of condensed coolant to pass to the liquid coolant containing vessel.

2. The cryostat according to claim 1, wherein the acoustic wave attenuator comprises a member having at least one channel with a diameter smaller than wavelength of the acoustic wave propagating in the gaseous coolant.

3. The cryostat according to claim 2, wherein the diameter of the at least one channel is several orders of magnitude smaller than the wavelength of the acoustic wave propagating in the gaseous coolant.

4. The cryostat according to claim 3, wherein the diameter is about 5 orders of magnitude smaller than the wavelength of the acoustic wave propagating in the gaseous coolant.

5. The cryostat according to claim 2, wherein said at least one channel of said acoustic wave attenuator has a diameter of substantially 2.5 mm.

6. The cryostat according to claim 2, wherein said member provides a plurality of said channels.

7. The cryostat according to claim 6, wherein said channels are substantially symmetrically arranged about a central axis of said acoustic wave attenuator.

8. The cryostat according to claim 1, wherein said acoustic wave attenuator is thermally non-conducting.

9. The cryostat according to claim 1, wherein said acoustic wave attenuator is made from one of PTFE, stainless steel, G-10, foam, plastics, FRP and ceramic.

10. The cryostat according to claim 1, further comprising an item to be cooled, the item being located in, or thermally connected to, said liquid coolant containing vessel.

11. The cryostat according to claim 10, wherein said item comprises a superconducting magnet.

12. An analyzing apparatus, comprising:

a cryostat having a liquid coolant containing vessel;

a pulse-tube refrigerator having at least one cooling stage located above the liquid coolant containing vessel;

a channel for conveying gaseous coolant from the liquid coolant containing vessel to the at least one cooling stage where the gaseous coolant is condensed in use and then returns through the channel to the liquid coolant containing vessel, an acoustic wave attenuator with a cylindrical body in which are formed a plurality of channels arranged in a regular array, located in the channel dissipates an acoustic energy of an acoustic wave originating from the pulse-tube refrigerator and propagating through the gaseous coolant, while permitting a flow of gaseous coolant to pass to the cooling stage and a flow of condensed coolant to pass to the liquid coolant containing vessel, and an item to be cooled, the item being located in, or thermally connected to, said liquid coolant containing vessel and including a superconducting magnet; and a system for analyzing a sample exposed to the magnetic field generated by the superconducting magnet.

13. The analyzing apparatus according to claim 12, wherein the analyzing apparatus carries out one of NMR, ICR, DNP and MRI.

14. A cryostat, comprising:

a liquid coolant containing vessel;

a pulse-tube refrigerator having at least one cooling stage located above the liquid coolant containing vessel;

a channel for conveying gaseous coolant from the liquid coolant containing vessel to the at least one cooling stage where the gaseous coolant is condensed in use and then returns through the channel to the liquid coolant containing vessel; and an acoustic wave attenuator located in the channel for attenuating an acoustic wave originating from the pulse-tube refrigerator and propagating through the gaseous coolant, while permitting a flow of gaseous coolant to pass to the cooling stage and a flow of condensed coolant to pass to the liquid coolant containing vessel, wherein the acoustic wave attenuator has a pair of outwardly extending semi-circular flanges at an upper end, in the at least one cooling stage of the pulse-tube refrigerator.

15. The cryostat according to claim 1, wherein diameters of the plurality of channels in the cylindrical body of the acoustic wave attenuator are substantially equal.

16. The cryostat according to claim 1, wherein diameters of the plurality of channels in the cylindrical body of the acoustic wave attenuator are optimized to maximize attenuation of the acoustic wave without preventing the flow of gaseous coolant to pass to the cooling stage and the flow of condensed coolant to pass to the liquid coolant containing vessel.

* * * * *